United States Patent [19]

Feitzinger et al.

[11] 4,167,319

[45] Sep. 11, 1979

[54] DEVICE FOR AMMONIA FUME REDUCTION

[75] Inventors: Eduard Feitzinger, Vestal; Emilio G. Mastroianni, Endicott, both of N.Y.

[73] Assignee: GAF Corporation, New York, N.Y.

[21] Appl. No.: 785,403

[22] Filed: Apr. 7, 1977

[51] Int. Cl.[2] ..... G03D 7/00

[52] U.S. Cl. ..... 354/300; 34/140; 34/155

[58] Field of Search ..... 354/299, 300; 355/30, 355/27; 55/70; 34/140, 141, 235, 155

[56] References Cited

U.S. PATENT DOCUMENTS

| | | | |
|---|---|---|---|
| 1,760,149 | 5/1930 | Langsner | 354/300 |
| 2,240,409 | 4/1941 | Morse | 354/299 |
| 3,467,491 | 9/1969 | Hardison | 23/2 |
| 3,679,369 | 7/1972 | Hashimoto et al. | 354/300 |
| 3,710,548 | 1/1973 | Coughlin | 55/73 |
| 3,720,150 | 3/1973 | Hurtig et al. | 354/300 |
| 3,900,862 | 8/1975 | Bennett | 354/300 |
| 4,059,409 | 11/1977 | Barto et al. | 354/300 |

FOREIGN PATENT DOCUMENTS

| | | | |
|---|---|---|---|
| 1414410 | 11/1975 | United Kingdom | 354/300 |

*Primary Examiner*—L. T. Hix
*Assistant Examiner*—Alan Mathews
*Attorney, Agent, or Firm*—Walter C. Kehm; J. Gary Mohr

[57] ABSTRACT

In a diazo-type copying apparatus, an improvement to prevent external leakage of gaseous ammonia to the atmosphere. The apparatus comprises a developing chamber, transport means within the chamber, means for introducing ammonia gas to the chamber, a first enclosure enclosing the chamber for sealing it from the atmosphere, a second enclosure containing the first enclosure as well as a perforated vacuum tube for collecting ammonia gases escaping from the first enclosure as well as for scrubbing ammonia gases from developed copies and exhausting the gases either to a liquid ammonia absorbing solution, a filter containing an ammonia absorbing solution, a cartridge containing ammonia absorbing pellets or a catalytic converter thereby preventing the ammonia gases from contaminating the atmosphere.

6 Claims, 3 Drawing Figures

DEVICE FOR AMMONIA FUME REDUCTION

BACKGROUND OF THE INVENTION

Escaping ammonia gases and the resultant fumes therefrom have long plagued the diazo-type copying apparatus art. Various methods have been suggested and tried in an effort to eliminate this problem. One method, disclosed in U.S. Pat. No. 1,760,149, was to place a perforated vacuum tube beneath an external copy collector tray of a developer. This met with some success, but since the vacuum tube was in contact with only one side of the copy produced, ammonia gas could escape from the opposite side of the copy. In addition, the vacuum was not applied until after the copy was exposed to the atmosphere external of the copier thereby affording the ammonia gas a chance to escape before the vacuum could even expel the ammonia gases from one side of the copy.

Another suggested method to prevent the escape of ammonia gases from a diazo-type copier is disclosed in U.S. Pat. No. 3,720,150. This patent discloses an alternate pressure vacuum channel system within the walls of the copier entrance and exit slots. At the points where the copy enters and exits, the copy is subjected to a pressure force which creates a barrier or back pressure to prevent ammonia gases from escaping the developing chamber and then the copy is subjected to a vacuum which collects any ammonia gas which remains on the copy or which may have escaped the developing chamber, but as yet had not reached the external atmosphere. While this method is effective in reducing the amount of ammonia gases that escape to the atmosphere, it requires two sets of vacuum channels and two sets of pressure channels in both the entrance and exit slots.

A third method which has been suggested in U.S. Pat. No. 3,900,862, discloses a vacuum chamber that operates at subatmospheric pressure, thereby eliminating the escape of ammonia gases from the developing chamber to the atmosphere. Escape is eliminated due to the differential between the atmospheric pressure and the subatmospheric pressure in the developing chamber, thereby forcing the surrounding atmosphere into the developing chamber as opposed to allowing the ammonia gases to escape the developing chamber. This, however, requires a large vacuum pump to maintain an area as large as a developing chamber at subatmospheric pressure.

Numerous methods have been tried to mechanically improve the seals located at the entrance and exit slots of the developing chamber, but without as much success as the use of vacuum seals.

In addition to containing the ammonia gases by one or more of the above methods, there is also the additional problem of eliminating the gases. The prior art discloses various ways of neutralizing the ammonia gases such as subjecting them to liquid absorbing solutions, filters containing ammonia absorbers, cartridges containing ammonia absorbing pellets and catalytic converters.

It is accordingly an object of the present invention to reduce the amount of ammonia gases and fumes that have a tendency to escape the developing chambers of diazo-type copiers without the resulting problems of the prior art.

SUMMARY OF THE INVENTION

This invention deals with an apparatus to greatly reduce the amount of ammonia gases and fumes that escape from a diazo-type copier and from developed diazo-type prints to the atmosphere. Ammonia gas fumes have a tendency to escape the developing chamber of a diazo-type copier whereupon they escape from the external housing of the copier to the surrounding atmosphere. The present invention eliminates or greatly reduces escaping ammonia gases from a diazo copier and diazo-type prints by placing the developing chamber within a capsule consisting of a stationary bottom, back, top and sides, as well as pivotal front cover. The capsule also has a print in-feed guide and print out-feed guide. Air pressure within the capsule is held below the surrounding ambient pressure by a perforated vacuum tube that extends across the entire width of the developer outlet. Prints or copies upon exit of the developing chamber travel through the capsule toward internal exit of the copier. Prior to internal exit, the prints are directed in proximity with the perforated vacuum tube wherein they are relieved of ammonia fumes prior to their internal exit. The perforated tube is connected to a vacuum pump which creates the vacuum within the tube to provide suction needed to draw the ammonia fumes from the prints prior to their internal exit of the copier. The ammonia fumes are then directed to either a filter containing an ammonia absorber, a cartridge containing ammonia absorbing pellets, a liquid ammonia absorbing solution or a catalytic converter for neutralization prior to release to the atmosphere.

DETAILED DESCRIPTION OF A PREFERRED EMBODIMENT

Figure 1:
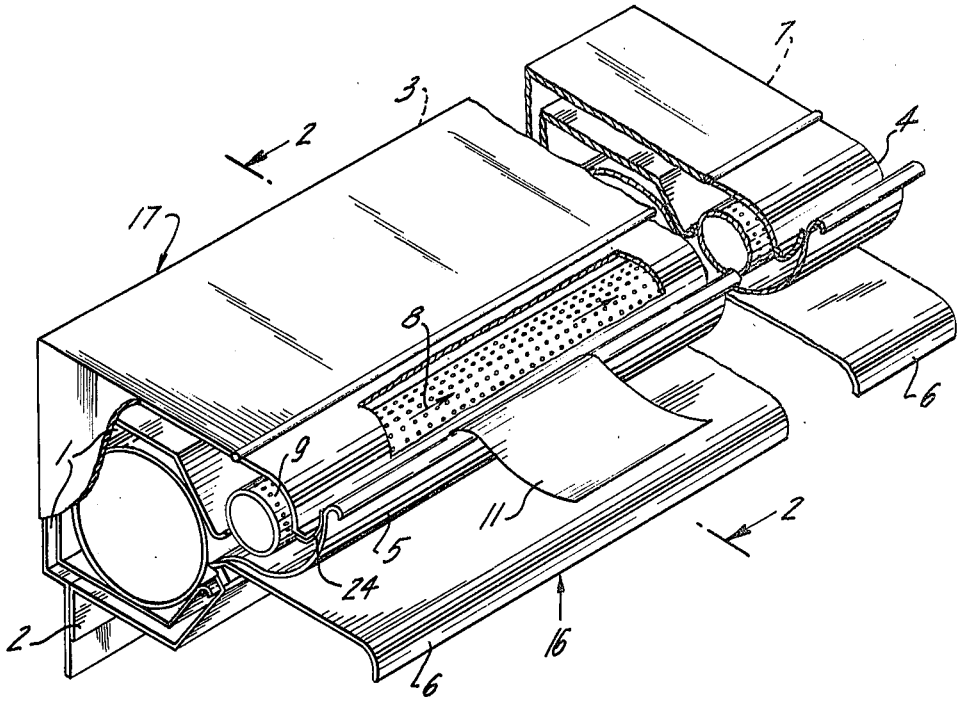
FIG. 1 is a front perspective view of a copying apparatus embodying the perforated vacuum tube of the invention.
Figure 2:
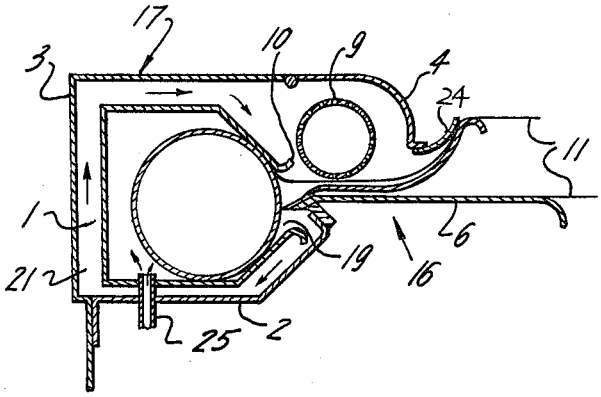
FIG. 2 is a side sectional view taken along lines 2—2 of FIG. 1 of the copying apparatus.
Figure 3:
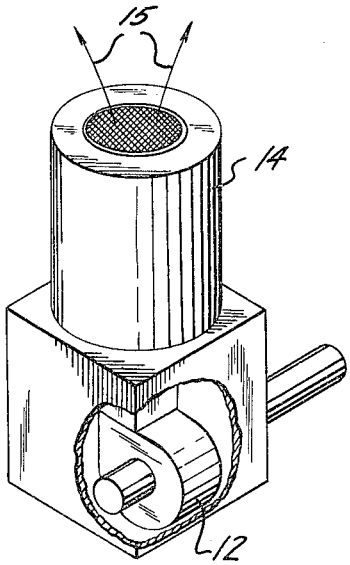
FIG. 3 is a rear perspective view of the vacuum pump, the ammonia treating means, and exhaust means.

Referring now to FIG. 1, a diazo-type copying apparatus 16 is provided with a developing chamber 1, incapsulated in a housing 17, consisting of a bottom panel 2, a back panel 3, a top panel 52, side walls 7 and a hinged front panel 4 for easy access to the interior of the housing 17. Also forming part of the housing 17 is a print out-feed guide 5 and a print in-feed guide 6. Tube 25 introduces ammonia gas to the developing chamber. Element 24 forms a seal between panel 4 and printed out-feed guide 5. Located within the housing 17 is a developer exit slot 10, and a perforated vacuum tube 9, which is located adjacent the print out-feed guide 5 and runs the full length of the housing 17. Connected to the perforated vacuum tube 9 is a vacuum pump or fan 12 as shown in FIG. 3, for creating a subatmospheric pressure within said tube 9. The vacuum pump 12 exhausts into element 14 which may be either a liquid ammonia absorbing solution, a filter containing an ammonia absorbing solution, a cartridge containing ammonia absorbing pellets or a catalytic converter.

In operation, a copy to be developed 11 is inserted into the housing 17 by way of the print in-feed guide 6 which directs the copy 11 to the entry of the developing chamber 19. The copy 11 is then transported through the developing chamber 1 where it is subjected to any one of many known developing methods prior to exit of the developing chamber 1 at developing chamber exit slot 10. The developed copy 11 is then directed past the perforated vacuum tube 9 where any ammonia fumes carried by it or which may have escaped from the developing chamber 1 are drawn into the perforated vacuum tube 9. After passing adjacent the tube 9 the developed copy 11 is directed externally of the housing 17 by way of the print out-feed guide 5. During operation there is a constant flow of air in the space 21 between the housing 17 and the developing chamber 1 towards the perforated vacuum tube 9 due to differential pressures. This air flow picks up any ammonia fumes that may escape from anywhere within the developing chamber and draws them into tube 9 thereby eliminating any escape of ammonia fumes from the interior of the housing 17. Once the ammonia fumes are drawn into said tube 9 they are subjected to a neutralizing process before being exhausted to the surrounding atmosphere 15. The neutralizing process consists of introducing the ammonia gas either to a liquid ammonia absorbing solution, a cartridge containing ammonia absorbing pellets, a filter containing an ammonia absorbing solution or a catalytic converter. After the neutralizing process, the neutralized gases are exhausted to the ambient 15.

The foregoing description is intended to be merely illustrative of the invention and other embodiments within the scope of this invention will be apparent to those skilled in the art.

What is claimed is:

1. An improved diazo-type copying apparatus having a developing chamber, a transport means within said developing chamber, a means for introducing ammonia gas into the chamber, a first enclosure means for enclosing and sealing the developing chamber from the atmosphere, a second enclosure enclosing and sealing the first enclosure from the atmosphere, an entrance means and an exit means within the second enclosure and the first enclosure for introducing a copy to be developed and expelling a developed copy from the developing chamber wherein the improvement comprises a perforated vacuum tube positioned within the second enclosure adjacent to and traversing the entire length of the exit means of the second enclosure, for collecting ammonia gases that escape the first enclosure as well as relieving the developed copy of ammonia gases and means for exhausting the collected ammonia gases to a neutralizing means prior to release into the atmosphere.

2. The improvement according to claim 1 wherein the means for exhausting the collected gases is a vacuum pump connected to the perforated vacuum tube and the neutralizing means.

3. The improvement according to claim 2 wherein the neutralizing means is a liquid ammonia absorbing solution.

4. The improvement according to claim 2 wherein the neutralizing means is a filter containing an ammonia absorbing solution.

5. The improvement according to claim 2 wherein the neutralizing means is a cartridge containing ammonia absorbing pellets.

6. The improvement according to claim 2 wherein the neutralizing means is a catalytic converter.

* * * * *